US008265306B2

(12) United States Patent
Frey

(10) Patent No.: US 8,265,306 B2
(45) Date of Patent: Sep. 11, 2012

(54) DIGITAL MICROPHONE AND POWER SUPPLY UNIT FOR A DIGITAL MICROPHONE

(75) Inventor: Tom-Fabian Frey, Braunschweig (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 953 days.

(21) Appl. No.: 12/287,706

(22) Filed: Oct. 10, 2008

(65) Prior Publication Data

US 2009/0097678 A1 Apr. 16, 2009

(30) Foreign Application Priority Data

Oct. 12, 2007 (DE) ..... 10 2007 049 245

(51) Int. Cl.
*H04R 23/00* (2006.01)

(52) U.S. Cl. ..... 381/150; 381/26; 381/92; 381/95; 381/111; 381/122; 381/369; 381/355

(58) Field of Classification Search ..... 381/92, 381/150, 26, 95, 111, 122, 355, 369
See application file for complete search history.

(56) References Cited

U.S. PATENT DOCUMENTS 6,031,362 A * 2/2000 Bradley ..... 323/269
2005/0232442 A1* 10/2005 Seknicka ..... 381/92

OTHER PUBLICATIONS

Wildlife Sound Recording Society (Jul. 1, 2007). Retrieved Feb. 14, 2012, from Internet Archive WaybackMachine Beta.*

* cited by examiner

*Primary Examiner* — Ha Tran T Nguyen
*Assistant Examiner* — Suberr Chi
(74) *Attorney, Agent, or Firm* — Kilpatrick Townsend & Stockton LLP

(57) ABSTRACT

Provided is a digital microphone having a power supply. In this case the power supply is configured so as to provide a P48 V phantom power.

6 Claims, 3 Drawing Sheets

DIGITAL MICROPHONE AND POWER SUPPLY UNIT FOR A DIGITAL MICROPHONE

CROSS-REFERENCE TO RELATED APPLICATIONS

This claims priority of German Patent Application No. 102007049245.8, filed Oct. 12, 2007, the disclosure of which is herein incorporated by reference in its entirety.

The present invention relates to a digital microphone and a power supply unit for a digital microphone.

BACKGROUND

In existing digital microphones the heat generation in the microphone may be too high.

SUMMARY

Therefore, the object of the present invention is to reduce the heat generation in a digital microphone.

The object of the present invention is attained by a digital microphone including a digital phantom power supply configured to provide a P48 V phantom power to the digital microphone.

According to one aspect of the present invention, the P48 phantom power is generated from a low pass filtered power supply, in particular, by means of a switched mode power supply unit.

According to an additional aspect of the present invention, the low pass filtered power supply is stepped down to a first bias by means of a switched mode regulating unit.

According to an additional aspect of the present invention, the switched mode regulating unit is configured as a switched mode power supply unit.

Thus, it is intended to supply power or rather current to digital devices, such as digital microphones, which are powered in accordance with AES42. In this case a P48 phantom powering of analog microphones can be provided at the analog signal input. Furthermore, an operating voltage for processing a high signal level can be provided.

As a result, the power loss in a digital microphone can be minimized. It is enabled that only a lower power consumption even in a high temperature and voltage range is possible. Furthermore, an effective generation of a P48 phantom power for feeding analog microphone capsules is allowed. Moreover, electromagnetic intrasystem interferences may be avoided. Furthermore, the development time can be shortened. Finally, the power consumption no longer necessarily rises with the required scanning frequency.

Other embodiments of the invention are the subject matter of the dependent claims.

BRIEF DESCRIPTION OF THE DRAWINGS

The embodiments and advantages of the invention are explained in detail below with reference to the drawings.

DETAILED DESCRIPTION

Figure 1:
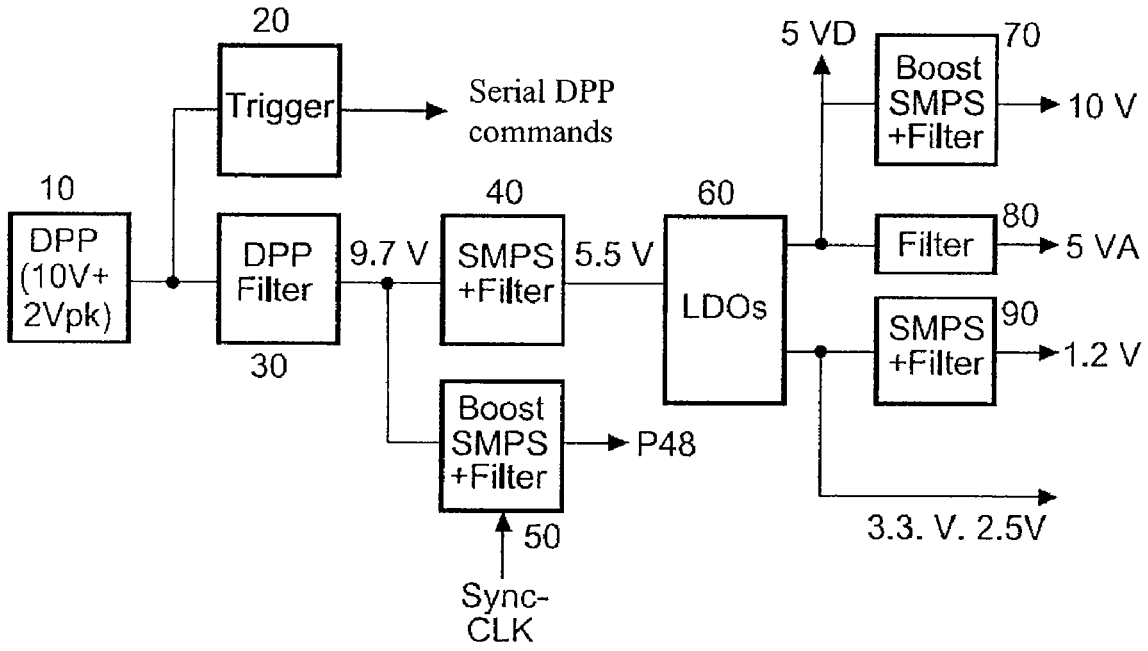
FIG. 1 is a schematic rendering of a block diagram of a power supply for a digital microphone, according to a first embodiment.

FIG. 1 is a block diagram of a power supply of a digital microphone, according to a first embodiment. The digital microphone, according to the first embodiment, constitutes a microphone, supporting the AES42 standard. Whereas the power supply circuits for digital microphones, according to the state of the art, produce a bias by means of a linear regulator, the first embodiment is based on a power supply design, which allows a P48 phantom power prefeed of analog microphone capsules.

The power supply for the digital microphone exhibits a DPP unit 10, which delivers a 10 V power. The output of the DPP unit 10 is low pass filtered in a DPP filter unit 30. The output of the DPP filter 30 exhibits a voltage of, for example, 9.7 V and is outputted to a switched mode regulating unit 40, which steps the voltage down to, for example, 5.5 V. The switched mode regulating unit 40 can constitute, for example, a switched mode power supply unit SMPS. The output of the switched mode regulating unit 40 (5.5 V) is passed on to a LDO voltage regulating unit 60. This LDO voltage regulating unit 60 can be a combination of a linear low dropout voltage regulating unit. The LDO voltage regulating unit serves to step the voltage at its input down to the desired operating voltage. Owing to the linear control, a filtered voltage having a low noise content and a uniform output impedance is produced. The outputs of the LDO voltage regulators are coupled with a first boost unit 70, a filter 80 and an additional switched mode regulator 80. The additional switched mode regulator 90 (SMPS) Switched Mode Power Supply serves to generate a low voltage having a high current load, such as a 1.2 V core voltage. This can lead to the power loss of the current supply being cut by half.

The output of the filter unit 30 (9.7 V) is also passed on to the second boost unit 50. A P48 phantom power can be generated using the second boost unit 50. Thus, the P48 phantom power for the digital microphone can be produced directly from the filtered DPP using a synchronous switched mode power supply unit 50. Furthermore, an active low pass filtering can be carried out. The switching frequencies of the asynchronous switched mode power supply unit SMPS are placed as far apart as possible in order to avoid inter-modulation products in the audio band.

Using the first boost unit 70, which is implemented, for example, as a low current switched mode power supply SMPS, an auxiliary voltage having approximately 10 V is generated in order to be able to process a high signal level in the analog portion.

Furthermore, there is a trigger unit 20, which is coupled with the output of the DPP unit 10 and emits serial DPP commands.

Thus, a digital microphone or rather a digital microphone module with an input, fed with a P48 phantom power, is shown. The P48 phantom power is generated from the filtered DPP.

Furthermore, a generation of a bias by means of a switched mode power supply prior to the actual voltage regulation can be provided.

Figure 2:
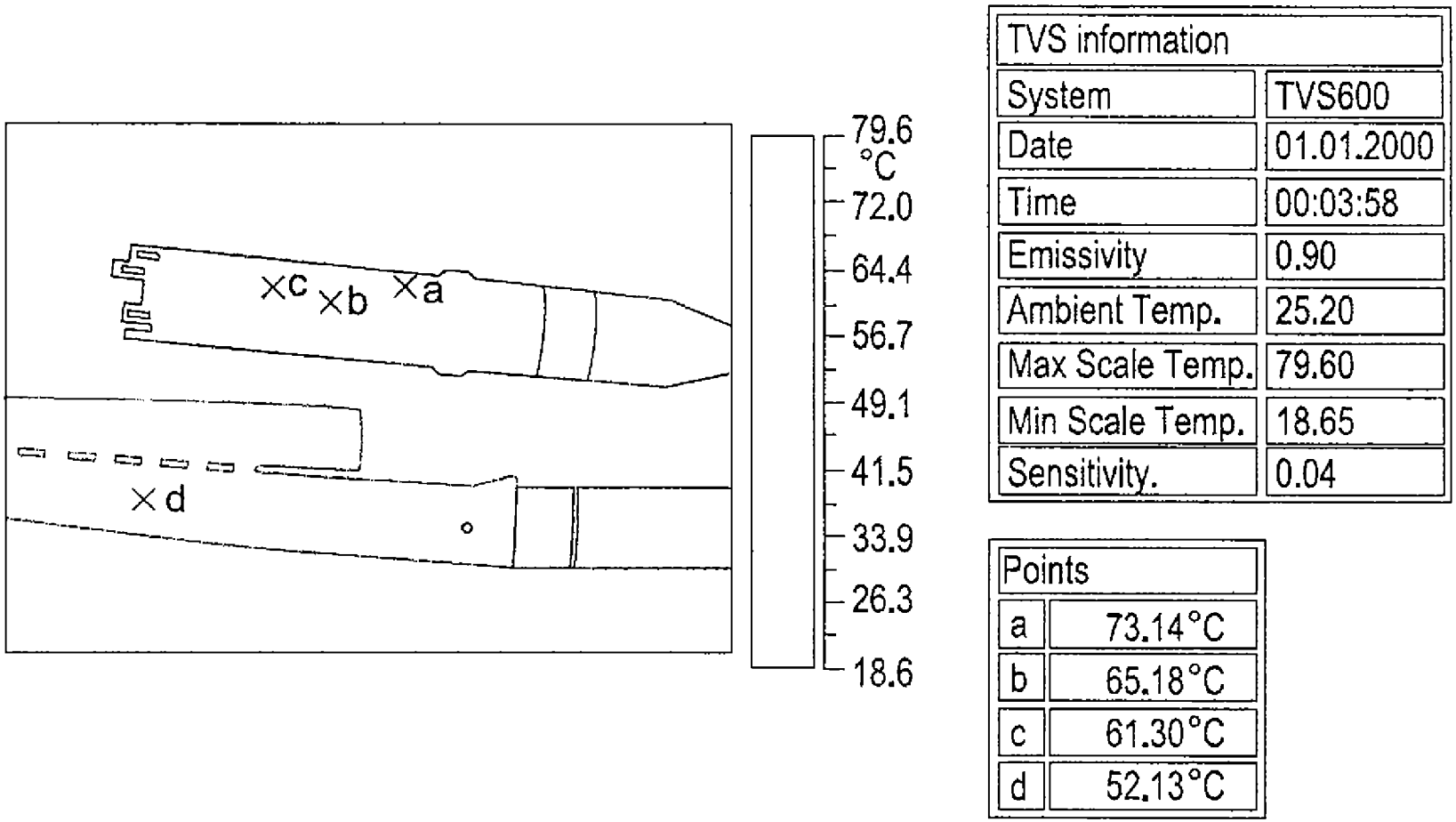
FIG. 2 shows a thermal image for a digital microphone.

FIG. 2 shows a thermal image of a digital microphone, according to the state of the art. In this case in particular four points a, b, c and d are shown.

Figure 3:
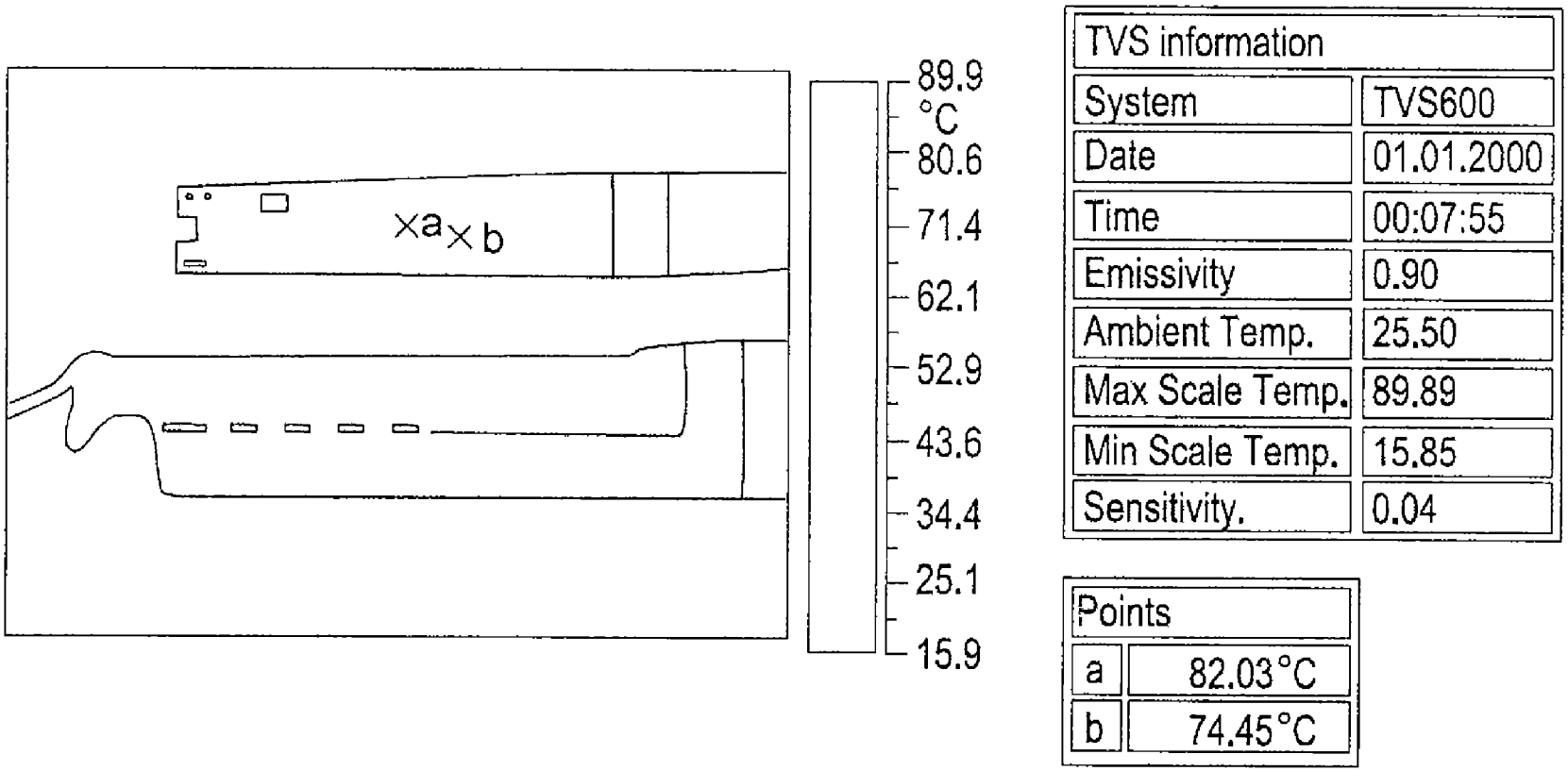
FIG. 3 shows an additional thermal image for a digital microphone.

FIG. 3 shows an additional thermal image of a digital microphone. In this case in particular the points a and b are shown.

The invention is based on the idea that the prior art digital microphones use linear regulators for regulating the voltage. This was done, in particular, because of the costs and the ensuing interfering noises due to the EMV problems in a highly resistive low frequency capacitor design.

In the digital microphone according to the invention, the digital microphone exhibits a P48-fed input. The power supply is implemented preferably by means of a switched mode power supply SMPS. In contrast, the currents for a voltage multiplier per cascade connection would be too high. The switched mode power supplies are preferably configured so as to be synchronizable. The digital microphone, according to the invention, uses an auxiliary voltage of approximately 10V for preprocessing high voltage levels in the audio signal.

The invention claimed is:

1. A method for supplying power to a digital microphone, the method comprising:

providing a P48 phantom power to the digital microphone, wherein the digital microphone is in accordance with the AES 42 standard;

filtering the P48 phantom power with a low pass filter;

stepping down the low pass filtered P48 phantom power to a first bias voltage by a switched mode power supply unit; and stepping down the first bias voltage to a first operating voltage by a voltage regulating unit.

2. The method of claim 1 wherein the voltage regulating unit is a low-dropout voltage regulating unit.

3. A digital microphone, wherein the digital microphone is in accordance with AES42 standard, comprising:

an analog microphone module having a P48 phantom interface; and a power supply configured to supply a P48 phantom power to the analog microphone module via the P48 phantom interface, said power supply having:

a first switched mode power supply unit configured to step down an input voltage of the digital microphone; and a second switched mode power supply unit configured to step up the input voltage to a P48 voltage.

4. The digital microphone according to claim 3, further comprising:

a voltage regulating unit coupled to the first switched mode power supply unit, the voltage regulating unit being configured to further step down the output voltage of the first switched mode power supply unit.

5. A digital microphone according to claim 4, wherein the voltage regulating unit is a low-dropout voltage regulating unit.

6. A digital microphone according to claim 3, wherein the second switched mode power supply unit is synchronized by a synchronization clock.

* * * * *

UNITED STATES PATENT AND TRADEMARK OFFICE

CERTIFICATE OF CORRECTION

PATENT NO. : 8,265,306 B2
APPLICATION NO. : 12/287706
DATED : September 11, 2012
INVENTOR(S) : Frey It is certified that error appears in the above-identified patent and that said Letters Patent is hereby corrected as shown below:

In the Specification:

Column 1, Line 9: after "in its entirety" please insert --for all purposes--.

Column 1, Line 37: please add a "," after "In this case".

Column 1, Line 59: after "embodiment" please delete the "." and insert a --;--.

Column 2, Line 2: please delete the "," after "microphone".

Column 2, Line 25: please delete "80" and insert --90--.

Column 2, Line 61: please delete "the" before "prior art digital".

In the Claims:

Column 3, Line 24, Claim 3: before "AES42" please insert --the--.

Signed and Sealed this
Eighth Day of January, 2013

David J. Kappos

David J. Kappos
*Director of the United States Patent and Trademark Office*